US007156614B2

(12) United States Patent
Racer et al.

(10) Patent No.: US 7,156,614 B2
(45) Date of Patent: Jan. 2, 2007

(54) CENTRIFUGAL PUMP WITH MULTIPLE INLETS

(75) Inventors: Donald W. Racer, Shelby, OH (US); Michael L. Keith, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 84 days.

(21) Appl. No.: 10/914,275

(22) Filed: Aug. 9, 2004

(65) Prior Publication Data

US 2005/0013689 A1 Jan. 20, 2005

Related U.S. Application Data

(63) Continuation-in-part of application No. 10/181,913, filed as application No. PCT/US01/02494 on Jan. 25, 2001, now Pat. No. 6,799,943.

(60) Provisional application No. 60/178,174, filed on Jan. 26, 2000.

(51) Int. Cl.
*F04D 29/42* (2006.01)

(52) U.S. Cl. ..... 415/116; 415/196; 415/127; 415/128; 415/206; 415/213.1; 415/214.1

(58) Field of Classification Search ..... 415/116, 415/127, 128, 196, 204–206, 213.1, 214.1
See application file for complete search history.

(56) References Cited

U.S. PATENT DOCUMENTS 1,134,655 A * 4/1915 White ..... 415/127

(Continued)

OTHER PUBLICATIONS

The Gorman-Rupp Company. Revised Date Apr. 18, 1991. Model No. 66C3-GF/SI. Outline No. 16324A.

(Continued)

*Primary Examiner*—Ninh H. Nguyen
(74) *Attorney, Agent, or Firm*—Tarolli, Sundheim, Covell & Tummino, LLP

(57) ABSTRACT

A centrifugal pump assembly that includes an inlet housing that defines a inlet chamber and at least one inlet port in fluid communication with the inlet chamber. A volute forming part of the assembly defines an outlet port. An impeller is mounted for rotation at least partially within the volute and operative upon rotation to convey fluid from the inlet port to the outlet port. The inlet housing defines mounting structure by which the inlet housing can be secured to the volute in any one of a plurality of positions with respect to the volute so that the spatial relationship between the inlet port and the outlet port can be changed by changing the relative position of the inlet housing with respect to the volute. The inlet housing also mounts a pump insert which may be either a dedicated clean-out assembly or structure defining an axial inlet port. The inlet housing defines a mounting flange that includes a plurality of symmetrically spaced apertures and the volute includes structure that is engageable with the flange and includes a plurality of symmetrically spaced bores that are alignable with the apertures formed in the mounting flange in several relative positions. The inlet housing may also be fitted with a aperture in an inlet housing wall for defining a radial inlet port communicating directly with the inlet chamber. Alternately, the inlet housing can include a passage for communicating a spaced inlet port with the inlet chamber. The passage may be jogged. The passage should be such to make the radial inlet and the radial outlet share a common plane, perpendicular to the axis of the impeller shaft. The impeller may form part of a rotating assembly which includes a mounting structure that enables the volute to be secured to the rotating assembly in any one of several positions.

26 Claims, 9 Drawing Sheets

U.S. PATENT DOCUMENTS

| | | | | | |
|---|---|---|---|---|---|
| 2,614,502 | A | * | 10/1952 | Wilfley et al. | 415/127 |
| 3,398,695 | A | * | 8/1968 | Pritz | 415/127 |
| 3,451,343 | A | | 6/1969 | Kabele | |
| 3,601,498 | A | | 8/1971 | Schroeder | |
| 3,628,881 | A | | 12/1971 | Hermann, Jr. | |
| 3,712,755 | A | | 1/1973 | Otto | |
| 3,776,659 | A | | 12/1973 | Coon, Jr. | |
| 3,778,181 | A | | 12/1973 | McFarlin | |
| 3,791,760 | A | * | 2/1974 | Lipe | 415/213.1 |
| 3,898,014 | A | | 8/1975 | Meister et al. | |
| 4,342,538 | A | | 8/1982 | Wolford et al. | |
| 4,460,276 | A | | 7/1984 | Arribau et al. | |
| 5,156,522 | A | | 10/1992 | Tessier | |
| 5,211,530 | A | | 5/1993 | Shiffler | |
| 5,591,001 | A | | 1/1997 | Ray et al. | |
| 5,599,164 | A | | 2/1997 | Murray | |
| 5,660,533 | A | | 8/1997 | Cartwright | |

OTHER PUBLICATIONS

The Gorman-Rupp Company. Revised Date Sep. 22, 1993. Model No. 66C-GE-(HYD). Outline No. 14994.

The Gorman-Rupp Company. Date Dec. 18, 2000. Model No. 612L-B. Outline No. 10587.

The Gorman-Rupp Company. Revised Date Oct. 9, 2002. Model No. 612L-B. Outline No. 14556.

* cited by examiner

CENTRIFUGAL PUMP WITH MULTIPLE INLETS

RELATE BACK

This application is a Continuation-in-Part of application Ser. No. 10/181,913, filed on Jul. 24, 2002, now U.S. Pat. No. 6,799,943 which is a 371 of PCT/US01/02494, filed Jan. 25, 2001, which claims benefit of provisional application Ser. No. 60/178,174, filed Jan. 26, 2000. This application also claims priority from Ser. No. 10/794,400, filed Mar. 8, 2004, entitled Stacked Self-Priming Pump And Centrifugal Pump.

TECHNICAL FIELD

The present invention relates generally to fluid pumps and, in particular, to a centrifugal pump having multiple inlets.

BACKGROUND ART

Centrifugal pumps are well known in the art and are used for many fluid pumping applications. For example, centrifugal pumps may be used to pump water from one water station to another. They may also be used in construction applications, i.e., to pump water from an excavation cite.

Occasionally, a pump may ingest solid material which can cause clogging of the pump or compromise its operation in other ways. Many times this clogging may necessitate the disassembly of the centrifugal pump in order to remove the material.

Clean-out assemblies allowing access to an impeller chamber have been used in internally self-priming, centrifugal pumps. Examples of pumps having this feature are known as "T-Series" pumps sold by The Gorman-Rupp Company. A self priming pump having clean-out capability is illustrated in U.S. Pat. No. 3,898,014.

DISCLOSURE OF INVENTION

The present invention provides a new and improved centrifugal pump that includes the ability to configure the pump with several inlet configurations. In addition, the pump includes a removable wear plate support/clean-out which provides access to an impeller chamber and which concurrently provides the ability to have alternate inlet configurations.

According to the invention, the centrifugal pump of the present invention includes a pump housing or body which defines an impeller chamber. An impeller, rotatable about an axis, is located within the impeller chamber. The impeller is rotatably driven by a suitable drive source, such as an electric motor or internal combustion engine.

The pump includes a substantially axial port and a substantially radial port which both communicate with the impeller chamber. The pump also includes an outlet port through which pumpage is discharged after passing through the impeller chamber.

In the illustrated embodiment, the pump includes a clean-out port which provides access to the impeller chamber to remove clogs, etc. In the preferred and illustrated embodiment, the removable wear plate/clean-out is an assembly located within the axial port which is removed in order to provide access to the impeller and/or a wear plate which is located axially adjacent the impeller.

According to a feature of the invention, the axial port can serve as an axial inlet to the pump. When the axial port is not used as an inlet port, the port is capped by a cap member or cover.

As indicated above, the pump also includes a radial inlet port through which pumpage is drawn. According to the invention, either the radial port or the axial port can be used as an inlet to the pump. In addition, both ports can be used concurrently as dual inlets to the pump.

According to another feature of the invention, the radial inlet port is arranged such that when it is not being used as an inlet, it can be used to provide access to the impeller chamber in order to remove clogs, debris, etc.

According to a more preferred embodiment, an axis of the radial port and an axis of the outlet port are coincident. The pump can be configured to rotate the outlet and/or inlet port while still maintaining a common plane.

According to a further feature of the invention, the axial port in which the clean-out assembly is mounted is configured to enable the impeller to be removed from the impeller chamber once the clean-out assembly is removed.

Additional features of the invention will become apparent in reading the following detailed description made in connection with the accompanying drawings.

BEST MODE FOR CARRYING OUT THE INVENTION

Figure 1:
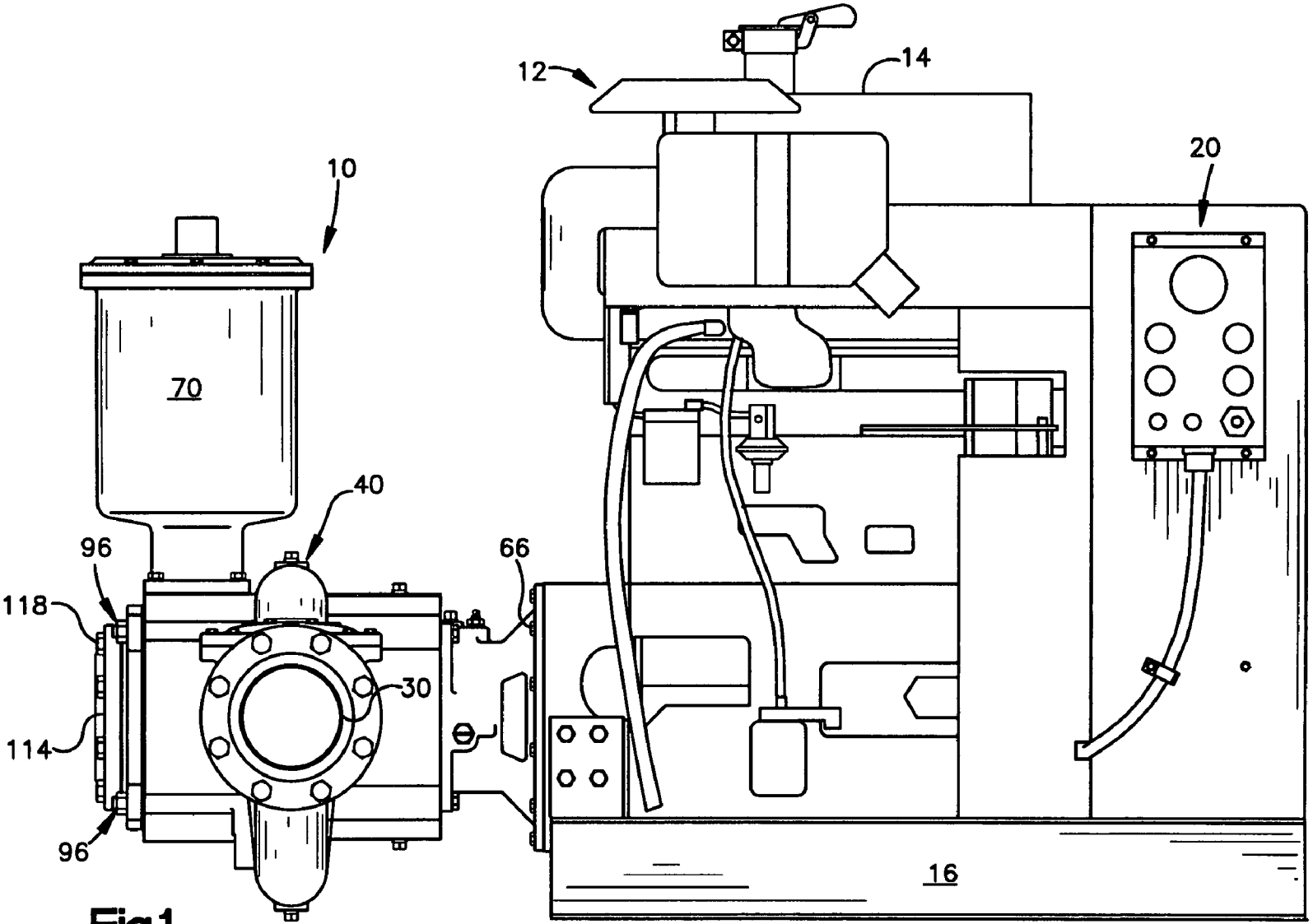
FIG. 1 is a side elevational view of a pumping system including a centrifugal pump constructed in accordance with the preferred embodiment of the invention.

FIG. 1 illustrates an overall view of a centrifugal pump and drive system constructed in accordance with a preferred embodiment of the invention. As seen in FIG. 1, the system includes a centrifugal pump indicated generally by the reference character 10 which is attached to and driven by a drive unit 12. In the illustrated embodiment, the drive unit includes an internal combustion engine 14 supported by a base 16. Controls indicated generally by the reference character 20 are also attached to the base, as well as other drive components (not shown in detail), which operatively connect the engine 14 to the centrifugal pump 10.

Figure 2:
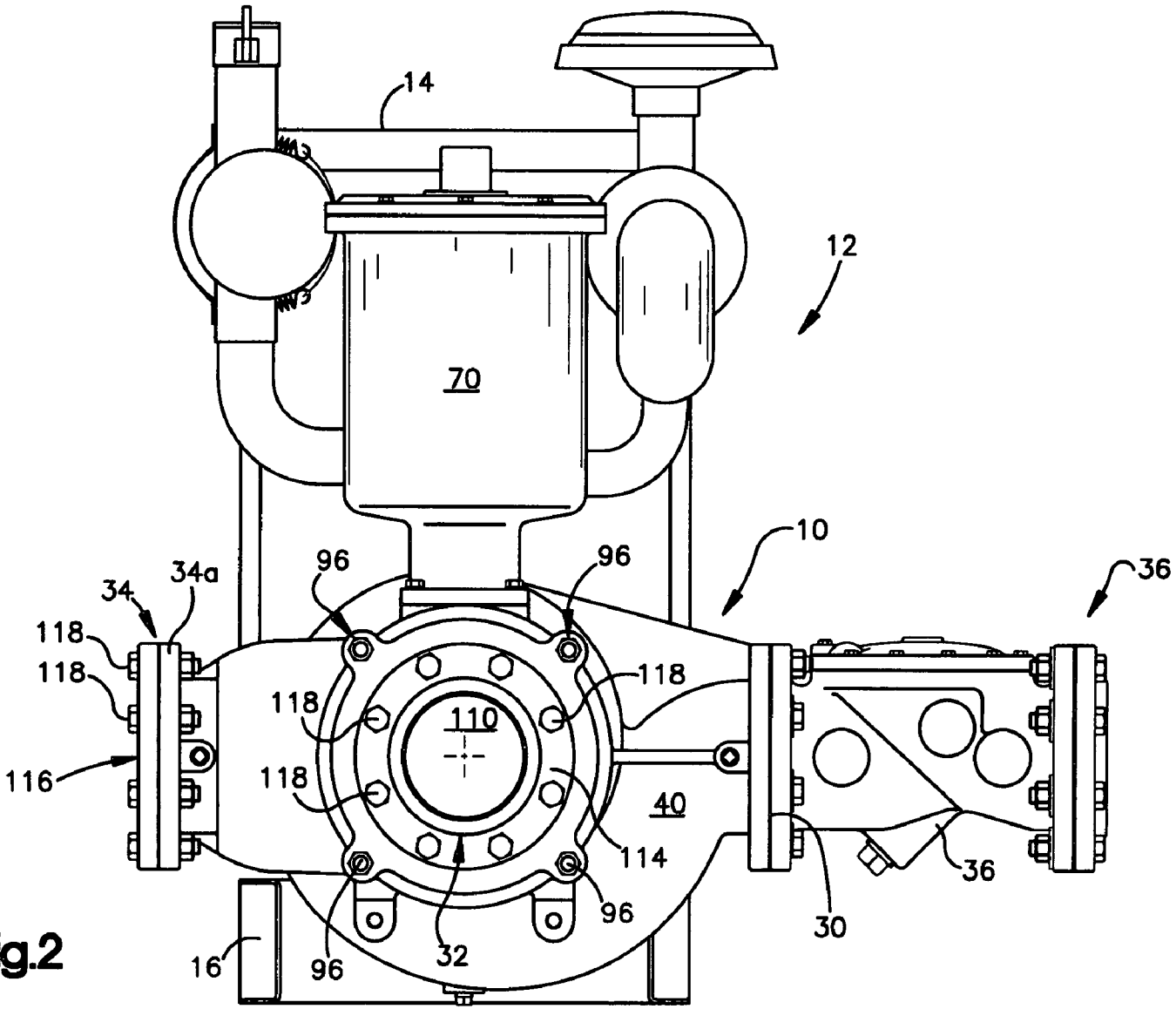
FIG. 2 is another side elevational view of the pump system shown in FIG. 1, but rotated 90° from the position shown in FIG. 1.

Referring also to FIG. 2, the centrifugal pump 10 includes a discharge port or outlet 30 (shown best in FIG. 1) and two inlet ports indicated generally by the reference characters 32, 34 (and shown best in FIG. 2). As will be explained, either port 32, 34 can serve as an inlet to the pump.

As seen in FIG. 2, the unit is shown with a discharge check valve 36 attached to the outlet 30. The discharge check valve is conventional and its operation is well known in the art. It is not considered part of the present invention.

Figure 3:
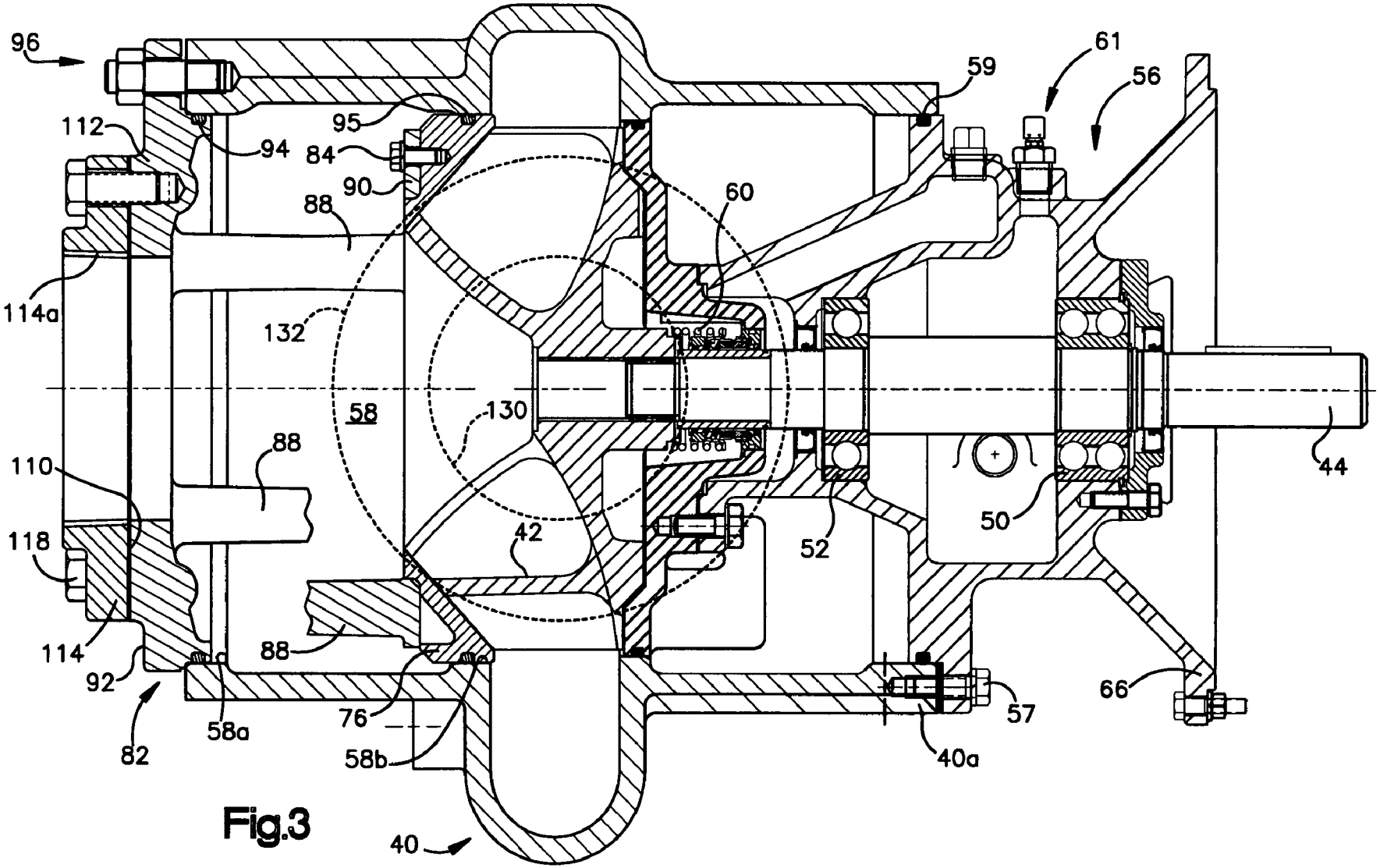
FIG. 3 is a fragmentary, sectional view of the centrifugal pump shown in FIGS. 1 and 2.

The pump 10 includes a volute or housing 40 which, as shown in FIG. 3, surrounds a pump impeller 42. As seen best in FIG. 3, the pump impeller 42, located in an impeller chamber 58, is rotated by a drive shaft 44 which extends from the pump housing 40. The impeller 42 is operatively connected to a drive source which, in the illustrated embodiment, is the engine-based drive unit 12 shown in FIG. 1. As seen in FIG. 3, the pump includes a flange 66 by which it is bolted to the drive unit 12.

Figure 8:
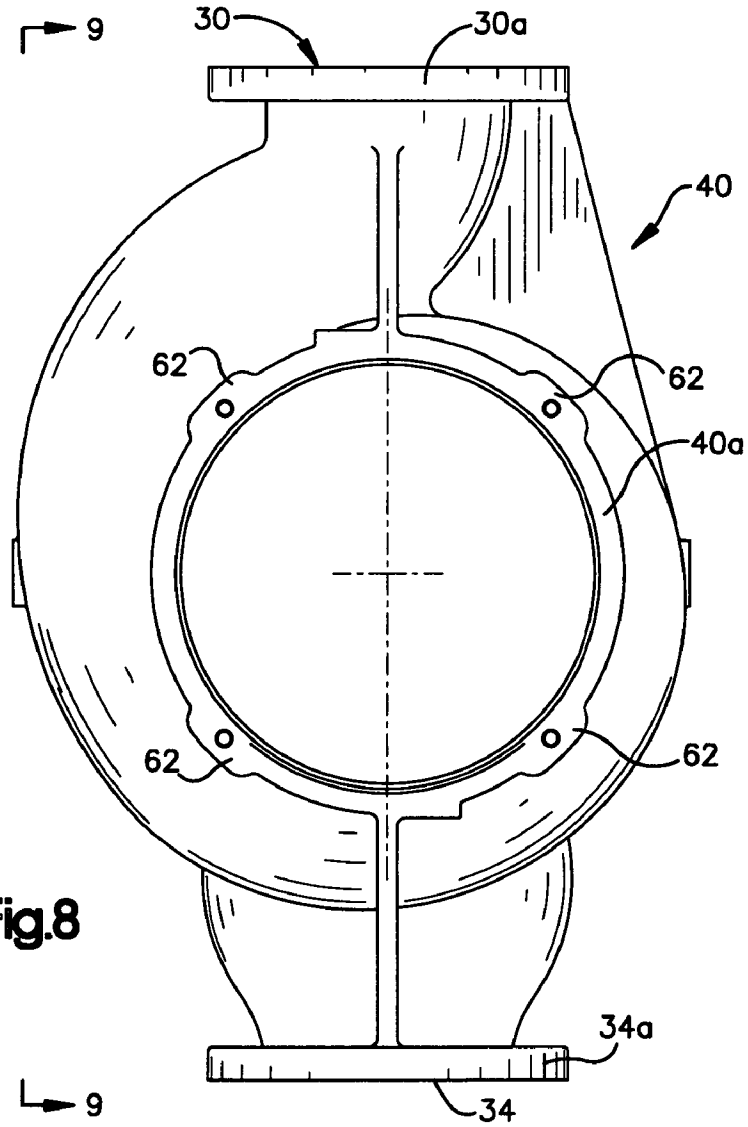
FIG. 8 is a rear elevational view of the pump housing shown in FIG. 6; and, FIG. 9 is a view of the pump housing as seen from the plane indicated by the line 9—9 in FIG. 8.

The drive shaft 44 is rotatably supported by bearings 50, 52. The bearings 50, 52 are mounted within an intermediate or bearing housing 56 which is secured to end flange 40*a* (shown best in FIGS. 3 and 8) of the volute 40 by a plurality of bolts 57 (only one of which is shown in FIG. 3). In particular, the intermediate housing 56 is bolted to threaded lugs 62 (shown best in FIG. 8) forming part of the end flange 40*a* defined by the volute 40. An O-Ring 59 seals the intermediate housing 56 to the volute 40. In the illustrated embodiment, the mounting flange 66 is an integral part of the intermediate housing 56. The intermediate housing also includes a vent 61 for venting the region between the bearings 50, 52.

Pumpage in the impeller chamber 58 is inhibited from leaking past the drive shaft 44 by a conventional face seal assembly 60. An example of the type of seal that can be used to seal the drive shaft is shown in U.S. Pat. No. 4,342,538, which is hereby incorporated by reference, and which is owned by the present assignee. Details of the seal and its operation can be obtained by reading the above-identified '538 patent, which is attached as Exhibit 1. Other types of seal assemblies, however, can be used to effect sealing of the drive shaft.

As in conventional, rotation of the impeller 42 (by the drive unit 12) draws fluid into the pump chamber 58 from an inlet to the pump and conveys it, under pressure, to the discharge 30.

In the illustrated embodiment, and as best seen in FIGS. 1 and 2, the pump is a prime-assisted type pump and includes a priming hopper 70 which facilitates initial start-up of the pump. As is known in the art, many centrifugal pumps require priming in order to begin the pumping operation. The priming hopper 70 serves this function and it may take the form illustrated in U.S. Pat. No. 5,660,533, which is hereby incorporated by reference, and which is owned by the present assignee. Details of the operation of the priming hopper can be obtained by reading the above-identified '533 patent, which is attached as Exhibit 2.

Figure 5:
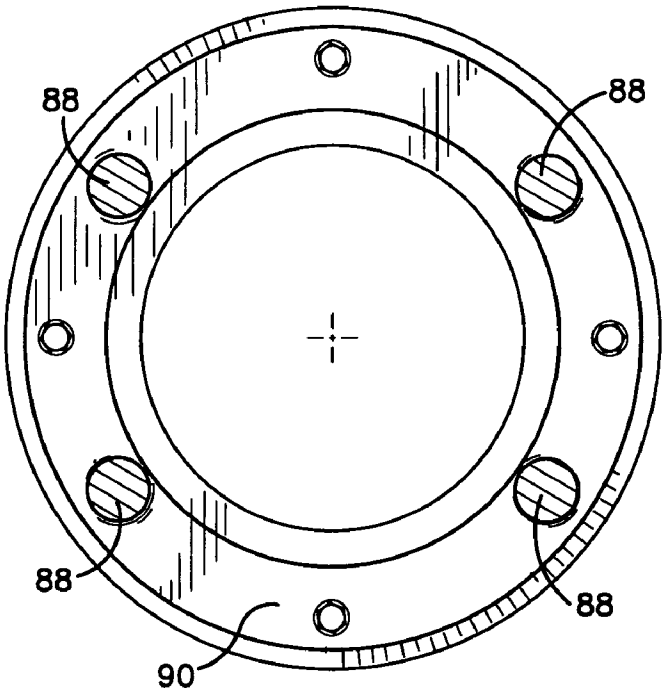
FIG. 5 is a sectional view of the wear plate support/clean-out as seen from the plane indicated by the line 5—5 in FIG. 4.
Figure 4:
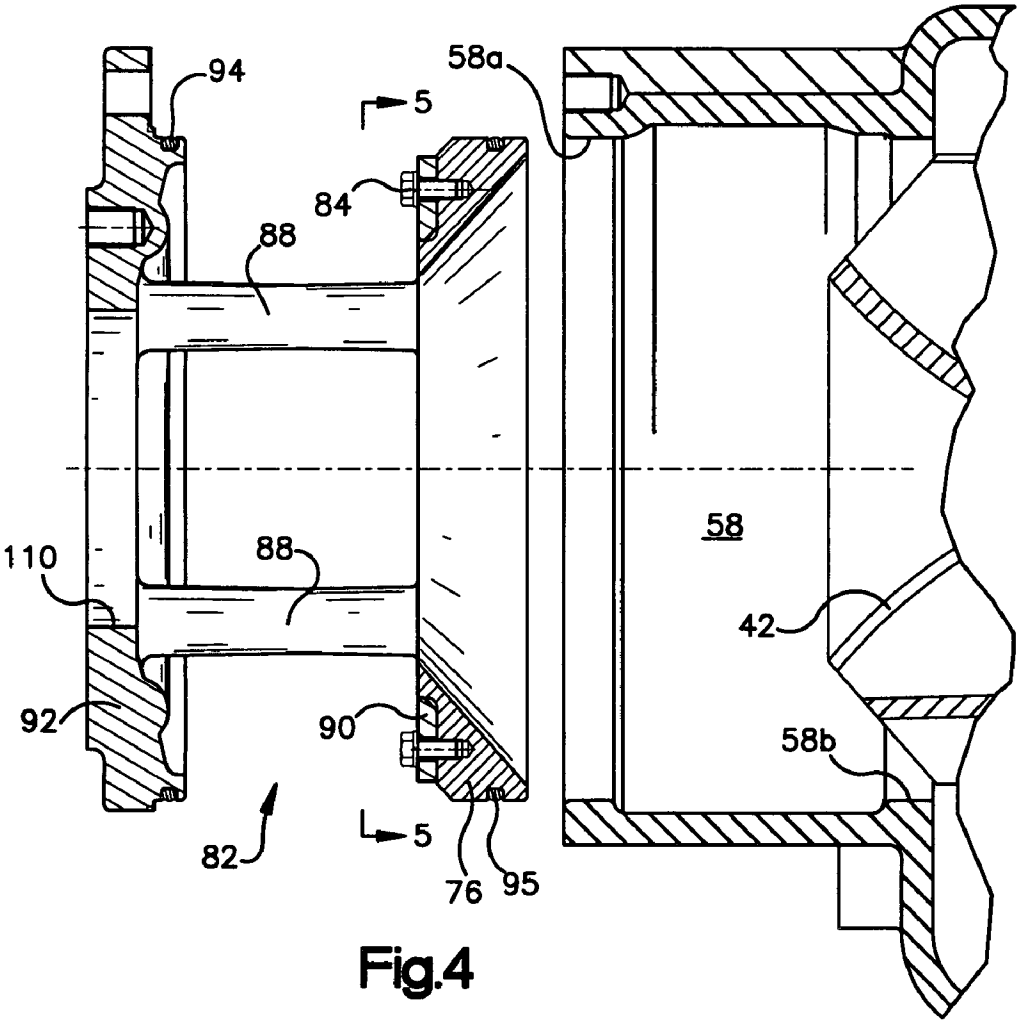
FIG. 4 is a fragmentary, exploded view showing a wear plate support/clean-out separated from the centrifugal pump.

In the illustrated embodiment, and as best shown in FIG. 3, the outboard end of the impeller (the left end of the impeller as viewed in FIG. 3) rotates immediately adjacent a wear plate 76. According to the present invention, the wear plate 76 is removably attached to a support indicated generally by the reference character 82 by a series of bolts 84 (only one is shown in FIG. 3). The wear plate support 82 is best shown in FIG. 4. In particular, the support 82 includes a plurality of column-like standoffs 88 to which a wear plate support ring 90 is attached or integrally formed therewith. See also FIG. 5. The column-like standoffs are attached to the inner side of a cap-like member 92. The cap-like member 92 sealingly engages inside surfaces 58*a*, 58*b* of the pump housing 40 and utilizes O-rings 94, 95 to provide fluid sealing. The cap-like member 92 is held to the housing by a plurality of studs and associated nuts, indicated generally by the reference character 96 (only one of which is shown in FIG. 3).

According to the invention, the support structure 82, including the cap-like member 92 can serve as a removable clean-out assembly to provide access to the impeller chamber 58 of the pump in order to clear debris or other matter from the pump housing. When the bolts 96 are removed, the entire support structure 82 including the wear plate 76 slides leftwardly as viewed in FIG. 3 and is thus removed from the pump chamber 58. Separation of the wear plate support/clean-out assembly 82 is best shown in FIG. 4.

In addition to providing clean-out access to the pump chamber 58, the removable clean-out assembly also allows servicing of the impeller 42 and the associated seal assembly 60. After the clean-out assembly 82 is removed, the impeller can be dismounted from the shaft 44 and removed from the pump through the opening left in the volute upon removal of the clean-out assembly.

The wear plate support/clean-out 82 also provides an additional feature of the invention. The support 82 can be configured as an inlet to the pump. In FIG. 3, this configuration is shown. As seen best in FIG. 3, the cap-like member 92 includes an aperture 110 and also defines a mounting flange 112 to which a pipe flange 114 forming part of an inlet conduit can be attached. The attachment of the conduit flange 114 to the housing flange 112 is conventional and is achieved by means well known in the art using a plurality of bolts 118. The pipe flange 114 includes an internal thread 114*a* (shown in FIG. 3) adapted to receive a threaded pipe/hose connection, nipple, etc.

When the support structure 82 defines the inlet port to the pump, the unit is considered to be in an axial configuration, in that the axis of the inlet conduit is at least parallel to the axis of rotation for the impeller 42. Preferably, the axis of the conduit is coincident with the axis of rotation.

When the support/clean-out 82 is used to provide the sole inlet to the pump 10, the port 34 must be sealed. This configuration is shown in FIG. 2. To achieve this sealing, a blind flange plate 116 is secured, by a plurality of bolts 118, to a mounting flange 34*a* forming part of the port 34.

Figure 7:
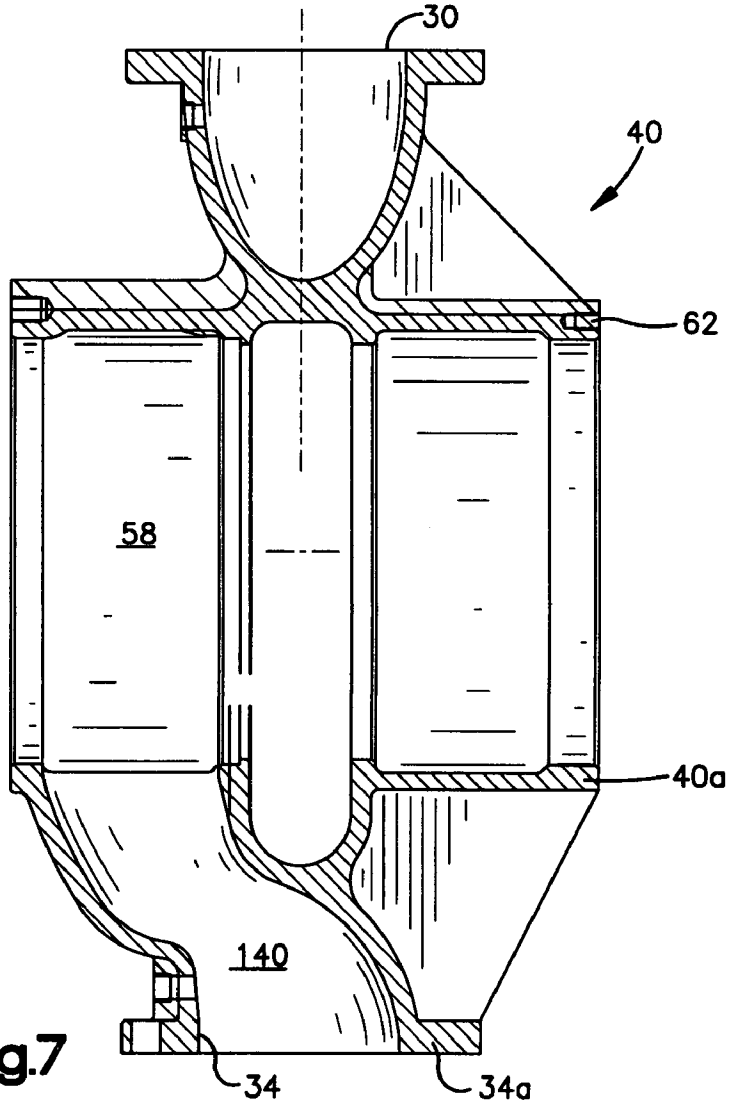
FIG. 7 is a sectional view of the pump housing as seen from the plane 7—7 in FIG. 6.
Figure 6:
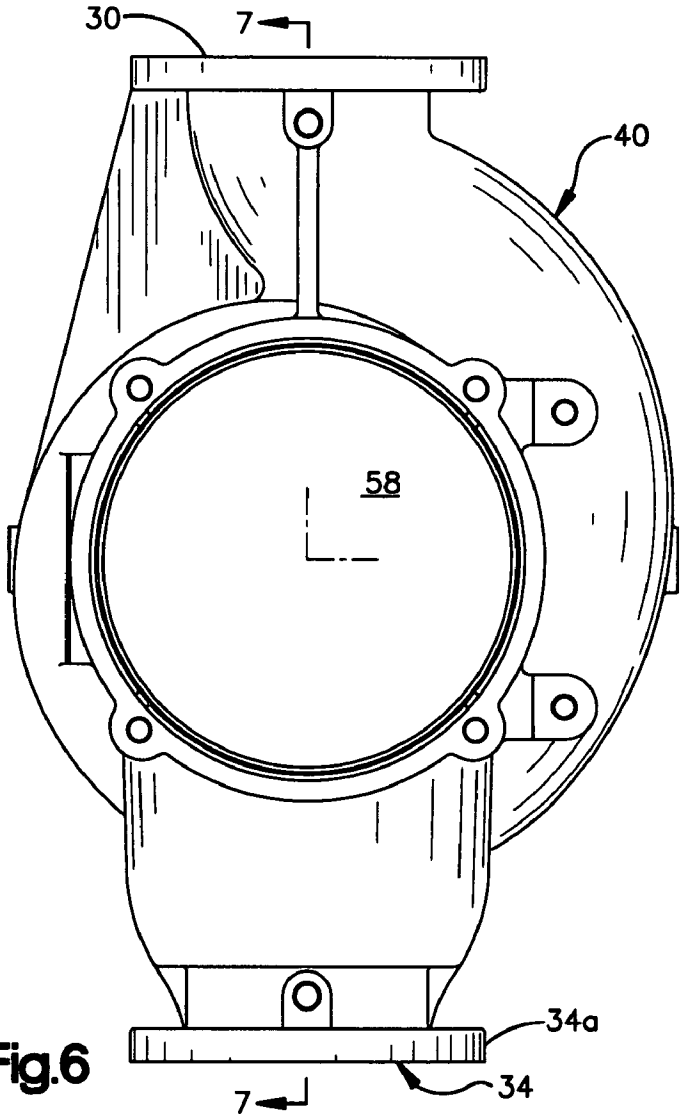
FIG. 6 is a side elevational view of a volute housing forming part of the centrifugal pump shown in FIG. 1.
Figure 9:
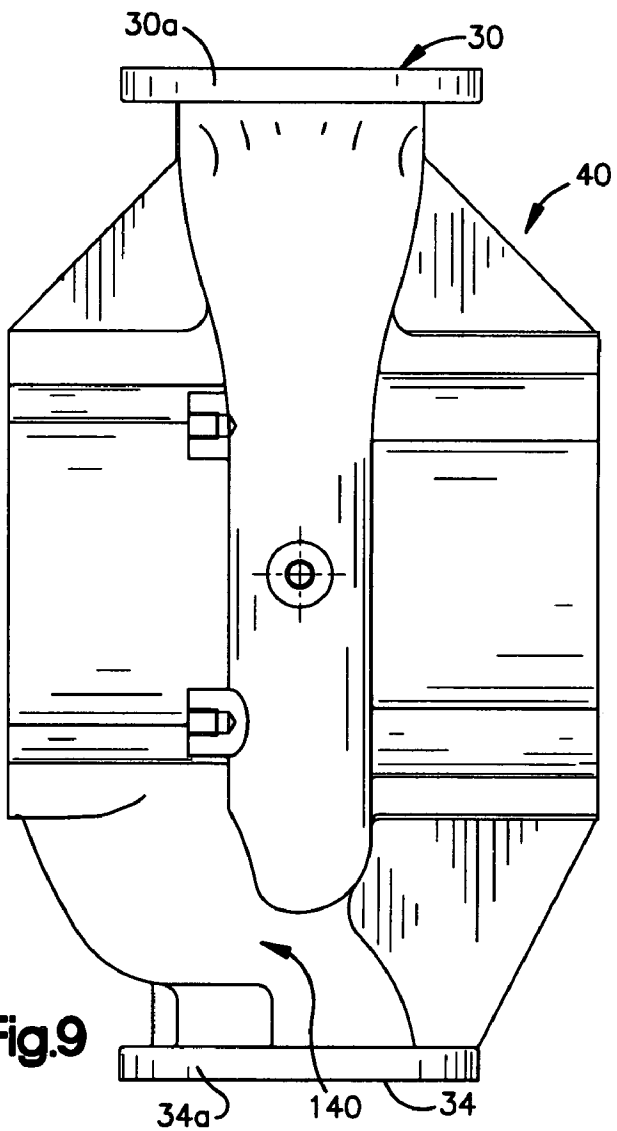

As will be explained below, the blind flange 116 can be removed when the port 34 is to serve as an inlet. According to a feature of the invention, the blind flange 116 can also serve as a clean-out cover when the port 34 is not serving as an inlet. By removing the blind flange 116, access to the impeller chamber 58 can be provided to facilitate removal of material, etc from the pump chamber 58 since the port 34 communicates with the chamber 58. This relationship is best shown in FIG. 7.

According to the invention, when an alternate inlet configuration is desired, the aperture 110 in the support/clean-out 92 can be capped using, for example, the blind flange cap 116 that in FIG. 2 is used to seal the inlet port 34. Alternately, the invention contemplates the use of a support/clean-out assembly 82 that has a solid end cap at its outermost end and, in this configuration, serves simply as a clean-out assembly rather than as a means for mounting an inlet conduit.

According to the invention, the inlet to the pump may be provided by the port 34. In this configuration, the port 32 would be sealed either by a support/clean-out 82 having a solid end cap or by capping the aperture 110 with a blind flange 116. In this configuration, the inlet would be considered a radial port, its axis being orthogonal to the rotational axis of the impeller 42.

According to another feature of the invention, both ports 32 and 34 can serve as concurrent inlets to the pump. It has been found that the pumping efficiency of the disclosed pump is improved when both inlets are used concurrently to provide source fluid to the pump chamber 58. In addition, this feature can be utilized in order to facilitate attachment of the pump to a piping/hose system. For example, if the centrifugal pump 10 is configured as a "8 inch" pump, i.e., the diameter of the inlet (and outlet) is 8 inches, significant effort may be needed to attach conduits to the pump flanges. This task can be eased significantly by utilizing a pair of 6 inch conduits (with suitable flange adapters) which are more easily manipulated by personnel installing the pump at the job site. Generally, it has been found that 8 inch conduit requires the aid of lifting machinery, whereas 6 inch conduit can be handled directly by personnel.

In the preferred embodiment, and as seen best in FIG. 3, the axes of the radial and discharge ports 34, 30 are parallel and preferably coincident or in the same plane. In FIG. 3, the inner peripheries of both the radial and discharge ports are indicated by the inner phantom line 130. The outer phantom line 132 indicates the outer peripheries of the mounting flanges.

Referring also to FIGS. 6–9 (which illustrate details of the pump housing 40), the method by which alignment of the radial inlet and discharge ports 34, 30 is achieved, is illustrated. The pump housing includes a jogged passage 140 which communicates the radial inlet 34 with the impeller pump chamber 58. This is the same chamber which the axial inlet directly communicates with. The jogged passage 140 allows the radial inlet 34 to be aligned with the discharge outlet 30. The passage 140 also allows access to the pump chamber 58 when the inlet 34 is capped and is used as a clean-out port as described above.

Figure 10:
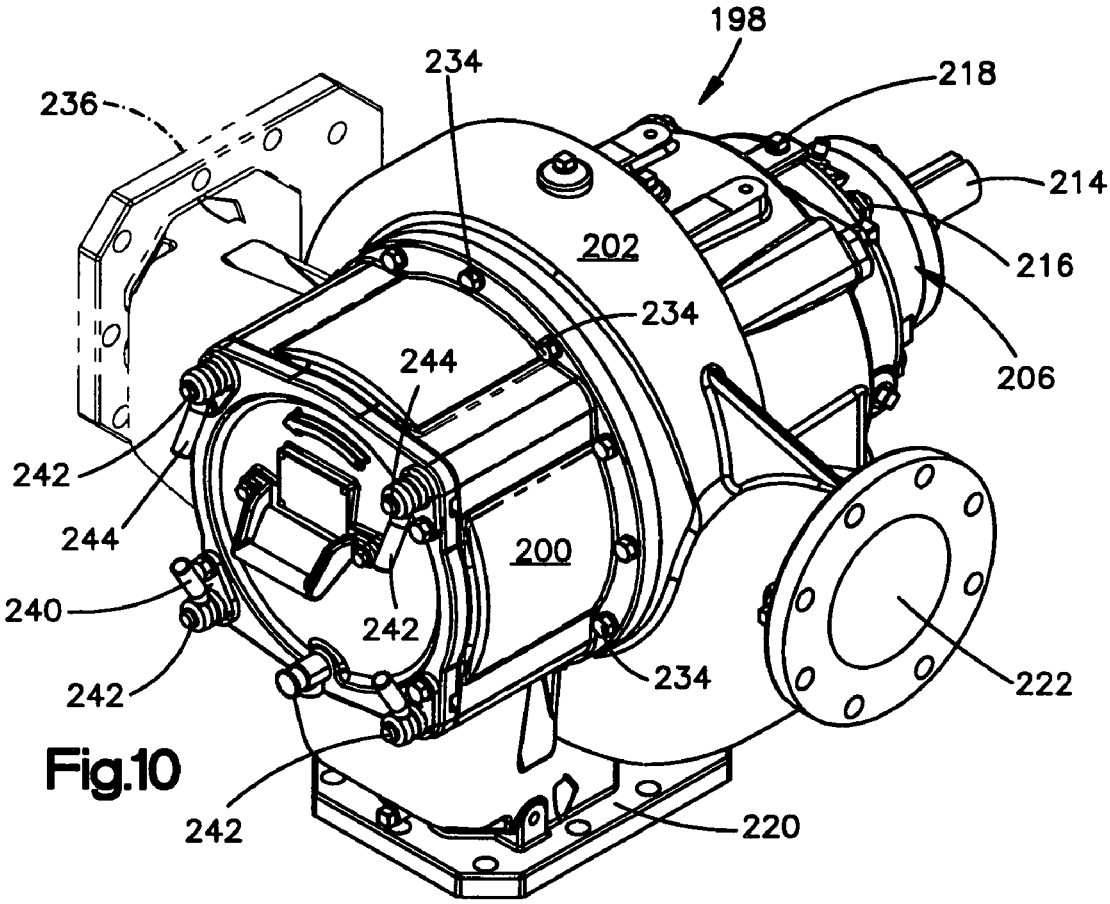
FIG. 10 is a perspective view of a pump assembly constructed in accordance with another embodiment of the present invention.
Figure 11:
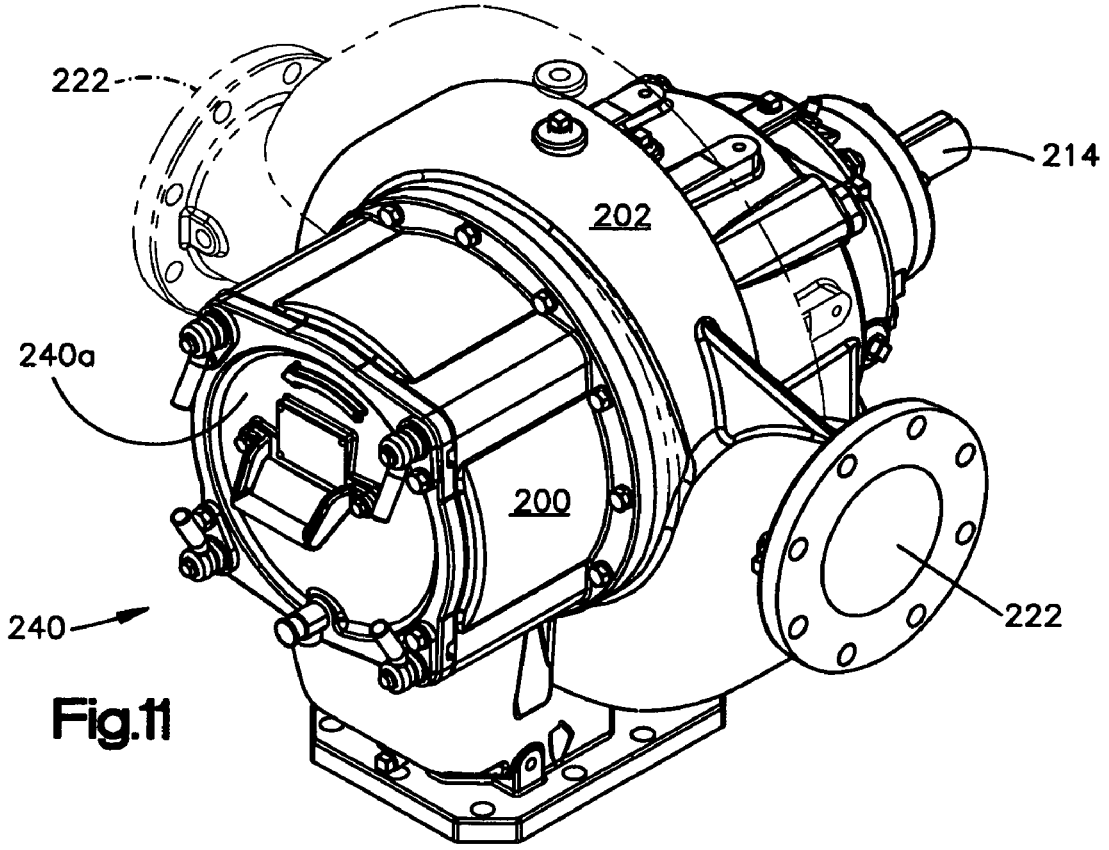
FIG. 11 is another perspective view of the pump assembly shown in FIG. 9 with a volute member illustrated in alternate positions.
Figure 12:
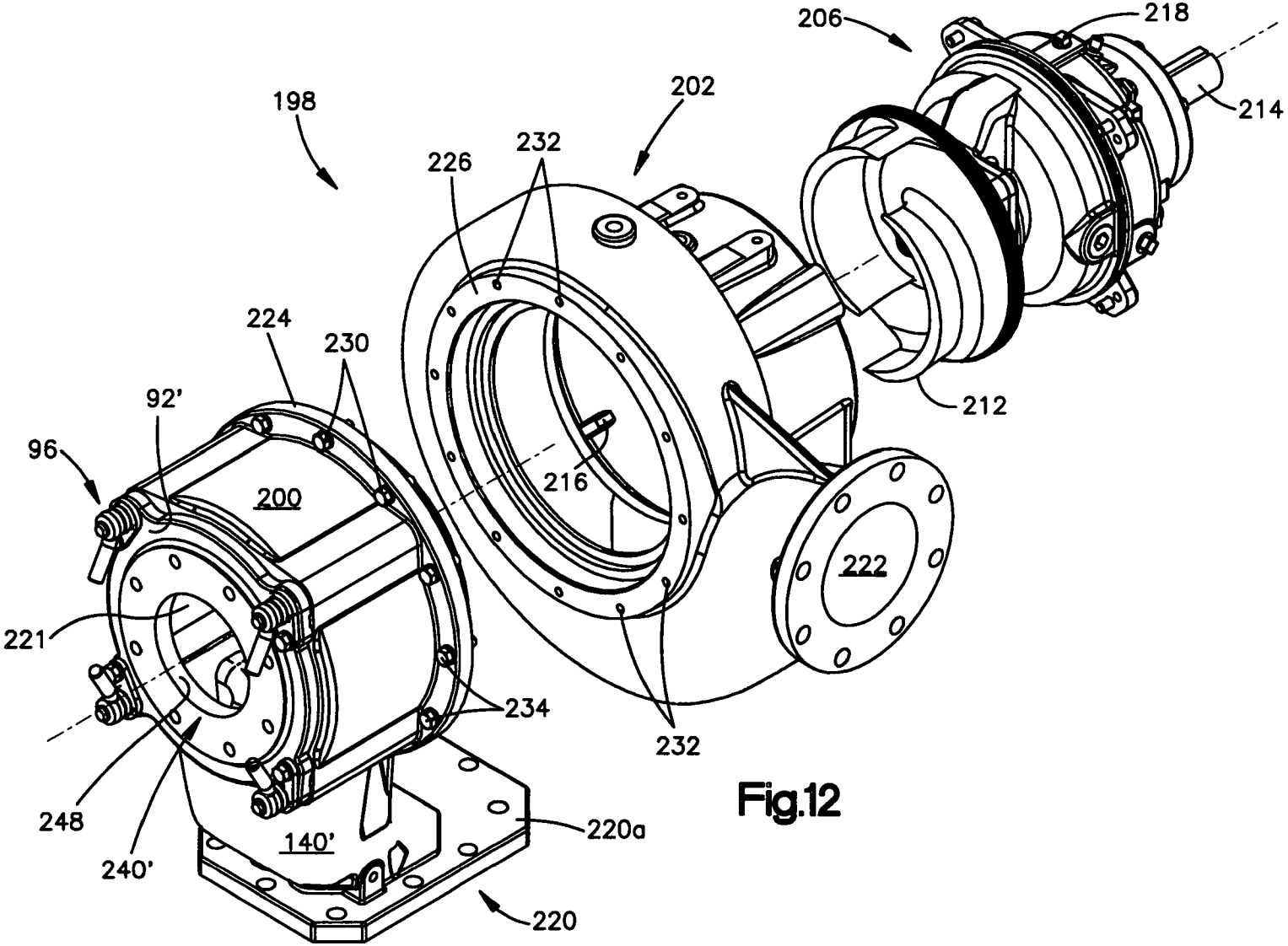
FIG. 12 is an exploded view of the pump assembly shown in FIGS. 10 and 11.

FIGS. 10–12B illustrate alternate embodiments of the invention. Referring, in particular, to FIGS. 10–12, one of the alternate embodiments of the invention comprises a pump assembly 198 that can be easily assembled into various configurations to accommodate particular applications or plumbing orientations. The pump assembly 198 includes an inlet housing 200 bolted to one side of a volute 202 and a rotating assembly indicated generally by the reference character 206 that is suitably secured to the other side of the volute 202. The rotating assembly 206 rotatably mounts an impeller 212 that rotates within the volute 202 in a conventional manner (shown in FIG. 12). A drive shaft 214 is operatively connected to the impeller 212 and extends outwardly of the rotating assembly 206. The drive shaft 214 can be conventionally connected to a drive motor (not shown) either directly or through a belt drive using known methods.

The rotating assembly 206, in the preferred embodiment, is mounted to the volute 202 with four symmetrically spaced fasteners 216. As is conventional, at least some rotating assemblies include lubrication chambers and vents such as vent 218 that must be oriented in a particular position, i.e., with the vents oriented upwardly. By using a symmetric bolt pattern, the volute 202 can be oriented with respect to the rotating assembly 206 in any one of four rotated positions. Therefore, like the clean-out assembly 240, the rotating assembly 206 can accommodate various orientations of the volute 202 and/or inlet chamber 200.

In the embodiment illustrated in FIGS. 10 and 11, the inlet housing 200 defines a substantially radial inlet 220 including a connecting flange 220*a* that communicates with an inlet chamber 221 (FIG. 12) via a jogged passage 140'. The passage 140' may be integrally cast into the inlet housing 200. The volute 202 defines a substantially radial outlet 222.

As seen best in FIG. 12, the inlet housing 200 also includes a mounting flange 224 that mates with a receiving flange 226 defined by the volute 202. In the preferred and illustrated embodiment, the flange 224 includes a plurality of symmetrically spaced apertures 230 that are alignable with a plurality of threaded bores 232 defined by the volute flange 226. Suitable bolts 234 (shown in FIGS. 10 and 11) are used to secure the inlet housing 200 to the volute 202. By using a symmetrically spaced bolt pattern, the inlet housing 200 can be mounted in various orientations. For example, and as seen in FIG. 10, the inlet housing 200 can be mounted so that the pump inlet 220 is oriented downwardly or to the side (as shown by the phantom lines 236 in FIG. 10). It should be understood that the inlet housing 200 can be bolted to the volute 202 so that the inlet 220 is oriented in other positions such as positions that are 180° from the positions shown in solid and in phantom in FIG. 10.

As seen in FIG. 11, because of the symmetrical bolt pattern, the volute 202 itself can be assembled so that the pump outlet 222 is positioned at alternate locations. In FIG. 11, the volute 202 is shown in positions that are 180° apart. It should be understood that the volute can be rotated 90° so that the discharge outlet 222 is pointed upwardly or downwardly to accommodate a particular application or a particular plumbing configuration.

In the embodiment illustrated in FIGS. 10 and 11, a clean-out assembly indicated generally by the reference character 240 is shown mounted in the inlet housing 200. The clean-out assembly 240 may be the same or similar to that shown in co-pending application Ser. No. 10/221,825, filed Sep. 16, 2002, which is hereby incorporated by reference. The clean-out assembly 240 may include a wear plate similar to the wear plate 76 shown in FIG. 3. The wear plate is supported in predetermined alignment with the impeller 212 by a plurality of standoffs that are the same or similar to the standoffs 88 shown in FIG. 3. The clean-out assembly 240 is removably held to the inlet housing 200 by a plurality of threaded studs 242 that extend from the inlet housing 200 and through apertures in a clean-out assembly mounting plate 240*a* and received removable threaded members 244. The clean-out assembly 240 may also be removably and adjustably held to the inlet housing 200 by threaded adjustment members more fully disclosed in co-pending application Ser. No. 10/181,913, filed Jul. 19, 2002, which is hereby incorporated by reference.

In the illustrated embodiment, the clean-out assembly 240 is held to the inlet housing 200 by the four threaded studs 242 and associated securement devices that are symmetrically spaced. As a consequence, the clean-out assembly 240 can be mounted to the inlet housing 200 in any one of four positions.

Figure 12A:
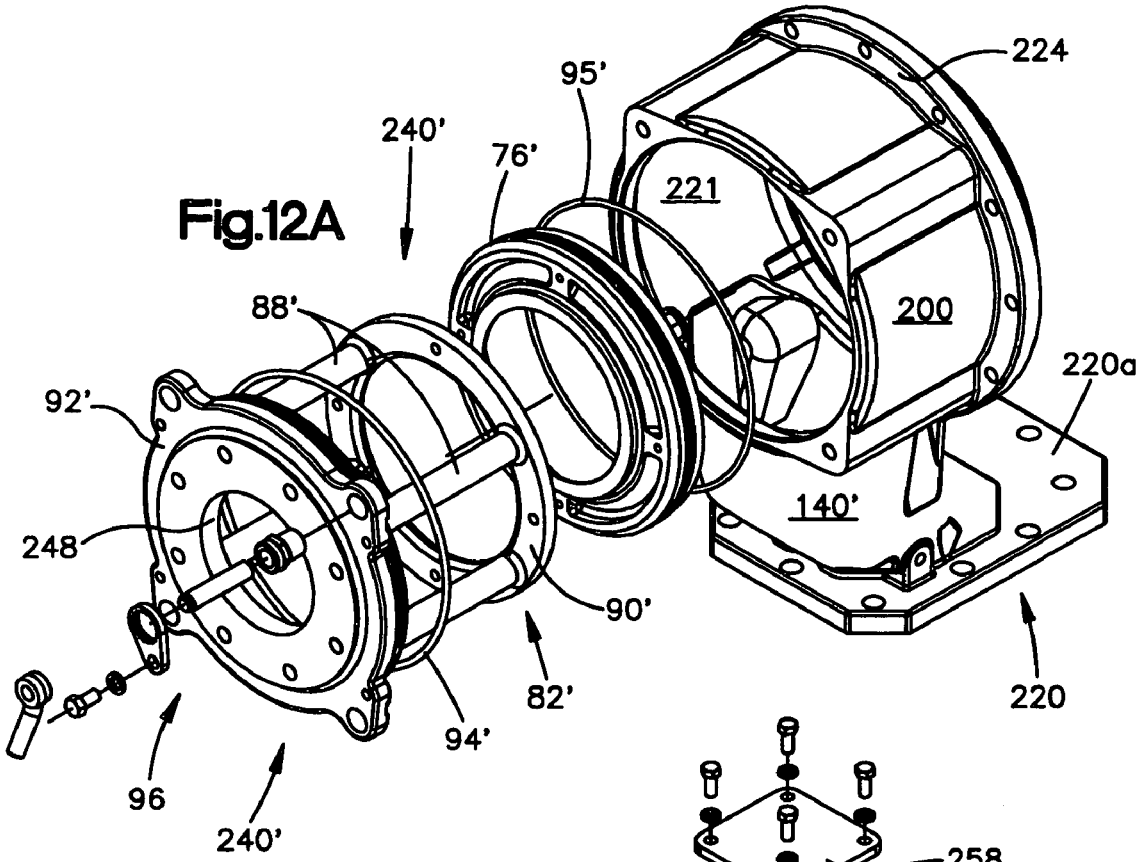
FIG. 12A is an exploded view of an alternate construction for an inlet housing which may form part of the pump assembly shown in FIG. 10; and, FIG. 12B illustrates another preferred construction of an inlet housing that may form part of the pump assembly shown in FIG. 10.

Referring now to FIGS. 12 and 12A, an alternate configuration of the centrifugal pump is illustrated. In this embodiment, the clean-out assembly 240 shown in FIGS. 10 and 11, is replaced with an alternate assembly 240' that defines an axial inlet port 248. The port assembly 240' (which may also serve as a clean-out assembly) is substantially similar to that shown in FIG. 3. To facilitate the explanation, parts shown in FIGS. 12 and 12A that are substantially similar to those in FIG. 3, will be indicated with the same reference character followed by an apostrophe. The port assembly 240' includes a cap-like member 92' that is held to the housing by a plurality of studs and associated threaded members indicated generally by the reference character 96. In the embodiment illustrated in FIG. 12, the port assembly 240' is adjustably held in position by the retaining and adjustment hardware shown in the above-referenced patent application Ser. No. 10/221,825, filed Sep. 16, 2002. A wear plate 76' is removably attached to a support forming part of the assembly indicated generally by the reference character 82'. The support 82' includes a plurality of column-like standoffs 88' to which a wear plate support ring 90' is attached or integrally formed therewith. The wear plate 76' is suitably secured as by bolts to the support ring 90'. The port assembly 240', including wear ring 76', are sealed to the inlet housing 200 by O-rings 94', 95'.

The pump configuration shown in FIGS. 12 and 12A provides dual inlets. An axial inlet is defined by the port opening 248 in the mounting plate 92' of the port assembly 240'. A radial inlet 220 is provided by the inlet housing 200. In the illustrated embodiment, the radial inlet 220 includes the mounting flange 220*a* which may be bolted directly to the outlet of an upstream pump. This type of dual pump configuration is illustrated and explained in the above-identified co-pending U.S. patent application Ser. No. 10/794,400, filed Mar. 8, 2004 and entitled Stacked Self-Priming Pump And Centrifugal Pump.

The port assembly 240' can be easily removed and, therefore, can also serve as a clean-out assembly when the pump is configured as a dual inlet pump. In this configuration, when access to the interior inlet chamber 221 of the inlet housing 200 is desired, the threaded retaining members are removed from the studs (indicated generally by the reference character 96 which releases the port assembly 240' and allows it to be pulled from the inlet housing 200.

Figure 12B:
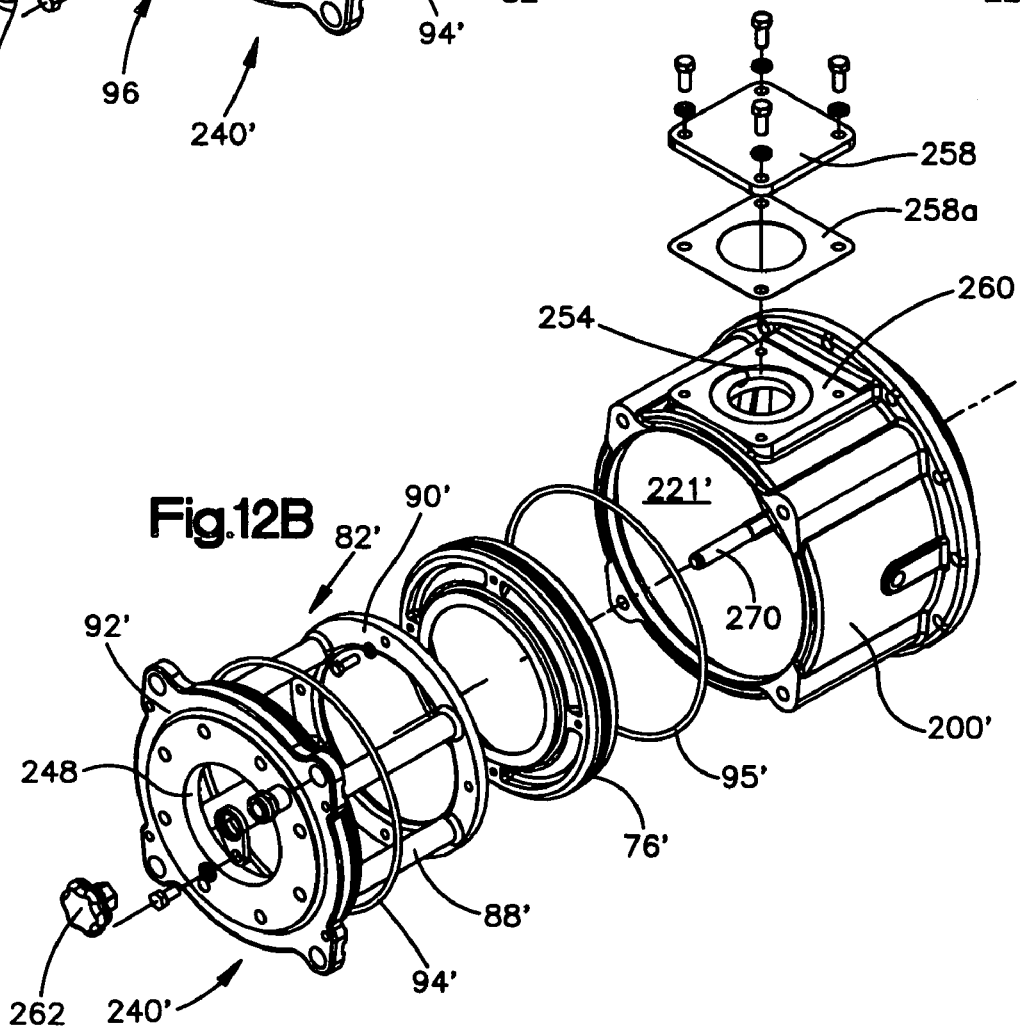

FIG. 12B illustrates an alternate construction for the inlet housing. In this construction, the inlet housing 200' does not include an integrally formed inlet or jogged passage 140' that is shown in FIG. 12. This inlet housing configuration would be used when it is desired to configure the pump with only an axial port or in applications where an integrally formed radial inlet having a mounting flange is not needed. The inlet housing 200' shown in FIG. 12B does have a radial port 254 that opens into interior or inlet chamber 221' of the housing 200' which when not being used, can be capped by a cover plate 258, and gasket 258*a*. When a radial port is desired, the cover plate 258 is removed and a conduit or other plumbing member (not shown) can be connected to a mounting surface 260 defined by the inlet housing 200' using conventional techniques.

In the embodiment shown in FIG. 12B, the port assembly 240' is held to the inlet housing 200' by hand nuts 262 that are received by threaded studs 270 extending from the inlet housing 200'.

The present invention thus provides an extremely flexible pump assembly that can be easily configured to accommodate particular pumping applications and conduit positioning. The volute 202 can be positioned in at least four different orientations in order to position the radial outlet 222 in at least two horizontal positions and at least two vertical positions. Similarly, the inlet housing 200 itself can be oriented with respect to the volute 202 in at least four different positions in order to position the integrally formed inlet 220 in at least two lateral positions and two vertical positions. Alternate constructions for the inlet housing are disclosed that can provide either single or dual inlets as needed. Moreover, the configuration of the disclosed pump can be reconfigured or reoriented at any time, even at the job site.

Although the invention has been described with a certain degree of particularity, it should be understood that those skilled in the art can make various changes to it without departing from the spirit or scope of the invention as hereinafter claimed.

We claim:

1. A pump assembly comprising:

a) an inlet housing defining:

i) an inlet chamber;

ii) at least one inlet port in fluid communication with said inlet chamber;

b) a volute defining an outlet port;

c) an impeller mounted for rotation at least partially within said volute and operative, upon rotation, to convey fluid from said inlet port to said outlet port; and, d) said inlet housing defining mounting structure by which said inlet housing is secured to said volute, said mounting structure enabling said inlet housing to be secured to said volute in any one of a plurality of positions with respect to said volute, such that a spatial relationship between said inlet port and said outlet port can be changed by changing the relative position of said inlet housing with respect to said volute, said inlet housing removably mounting a clean-out assembly which, when removed, provides access to said inlet chamber.

2. The pump of claim 1 wherein said impeller forms part of a rotating assembly and said volute can be secured to said rotating assembly in any one of a plurality of positions.

3. The pump of claim 1 wherein said clean-out assembly is replaceable by structure defining an axial inlet port.

4. The pump of claim 1 wherein said mounting structure comprises a flange including a plurality of symmetrically spaced apertures and said volute includes structure abuttably engageable with said inlet housing flange and including a plurality of symmetrically spaced bores alignable with said apertures formed in said mounting flange.

5. The pump of claim 4 wherein said bores on said volute are alignable with said apertures in several relative positions between said inlet housing and said volute.

6. The pump of claim 1 wherein said inlet port is axially aligned with an axis of rotation of said impeller.

7. The pump of claim 1 wherein said inlet port is substantially radially directed with respect to an axis of rotation of said impeller.

8. The pump of claim 7 wherein said radial port is connected to said inlet chamber via structure that defines a jogged passage.

9. The pump of claim 1 wherein said clean-out assembly mounts a wear ring in a confronting relationship with said impeller.

10. The pump of claim 1 wherein said inlet port is at least partially defined by a mounting flange that enables said inlet port to be directly connected to an outlet port of another pump.

11. A centrifugal pump assembly, comprising:

a) an inlet housing, including i) an inlet chamber;

ii) a substantially radially directed port in fluid communication with said inlet chamber;

b) a volute subassembly including:

i) a volute defining a volute chamber and a substantially radially directed discharge port communicating with said volute chamber ii) an impeller supported for rotation within said volute chamber;

c) said inlet housing including an opening for receiving a replaceable, pump insert, said insert supporting an impeller wear plate in an operative position with respect to said impeller;

d) said inlet housing defining a mounting flange for securing said inlet housing to said volute subassembly, said mounting flange arranged such that said inlet housing can be mounted to said volute subassembly in any one of a plurality of positions such that the angular relationship between said inlet port and said discharge port can be varied to suit particular applications.

12. The centrifugal pump of claim 11 wherein said volute subassembly includes a volute member and a rotating assembly attached to said volute member, said rotating assembly rotatably supporting a drive shaft that drivingly engages said impeller.

13. The centrifugal pump of claim 12 wherein said rotating assembly includes a mounting flange by which said rotating assembly can be attached to said volute member in any one of a plurality of positions.

14. The centrifugal pump of claim 11 wherein said pump insert comprises a clean-out assembly which is removable in order to gain access to said impeller.

15. The centrifugal pump of claim 11 wherein said pump insert comprises structure defining an axial inlet port that is in fluid communication with said inlet chamber.

16. The centrifugal pump of claim 11 wherein said radial port is defined by an aperture formed in a wall of said inlet housing.

17. The centrifugal pump of claim 16 wherein said inlet housing includes a blocking member for closing off said radial port.

18. The centrifugal pump of claim 11 wherein said radial port is defined by port structure forming part of said inlet housing, said structure defining a passage that extends from said inlet chamber to said radial port.

19. The centrifugal pump of claim 18 wherein said port structure defines a mounting flange whereby said radial port can be directly connected to a discharge port of another pump.

20. The centrifugal pump of claim 11 wherein said mounting flange includes a plurality of symmetrically spaced apertures and said volute defines a flange mounting surface engageable with said inlet housing flange, said mounting surface including a plurality of symmetrically spaced bores that are alignable with said flange apertures in any one of several relative positions between said inlet housing and said volute subassembly.

21. A dual inlet centrifugal pump assembly comprising:

a) an impeller mounted for rotation within a volute chamber forming part of a volute subassembly;

b) an inlet housing secured to said volute subassembly, said inlet housing defining:

i) an inlet chamber communicating with said volute chamber;

ii) a substantially radially directed port communicating with said inlet chamber;

iii) a pump insert received within said inlet chamber and defining an axial port in communication with said inlet chamber;

iv) said pump insert supporting a wear plate in an abutting relationship with said impeller;

v) said inlet housing defining mounting structure by which said inlet housing is secured to said volute, said mounting structure arranged such that said inlet housing can be attached to said volute in any one of a plurality of positions in order to change the relationship between said radial port defined by said inlet housing and a discharge port defined by said volute.

22. The dual inlet centrifugal pump of claim 21 wherein said pump insert also serves as a removable clean-out subassembly by which access to said impeller is obtained.

23. The dual inlet centrifugal pump of claim 22 wherein said radial port forms part of a passage that extends from said inlet housing to said radial port.

24. The dual inlet centrifugal pump of claim 23 wherein said passage is a jogged passage.

25. The dual inlet centrifugal pump of claim 22 wherein said radial port is defined by a through aperture formed in a wall of said inlet housing.

26. The dual inlet centrifugal pump of claim 22 wherein said impeller forms part of a rotating assembly that is secured to a volute member, said rotating assembly arranged such that it can be secured to said volute member in any one of a plurality of positions in order to change a relationship between a discharge port forming part of said volute and at least one bearing chamber forming part of said rotating assembly.

* * * * *